United States Patent [19]

Lane

[11] Patent Number: 4,766,609

[45] Date of Patent: Aug. 30, 1988

[54] FIRE FIGHTER HELMET AND FACE SHIELD

[75] Inventor: Abbott A. Lane, Dayton, Ohio

[73] Assignee: Firequip Helmets, Inc., Dayton, Ohio

[21] Appl. No.: 32,795

[22] Filed: Mar. 31, 1987

[51] Int. Cl.[4] ..... A42B 3/00

[52] U.S. Cl. ..... 2/5; 2/424

[58] Field of Search ..... 2/424, 425, 10, 6, 5, 2/7, 8, 9, 427, 428, 422, 410

[56] References Cited

U.S. PATENT DOCUMENTS

| | | | |
|---|---|---|---|
| 1,306,550 | 6/1929 | Malcom | 2/8 |
| 2,103,006 | 12/1937 | Helfenstein et al. | 2/8 |
| 2,421,427 | 6/1947 | Mamlin et al. | 2/5 |
| 2,538,608 | 4/1948 | Vaca | 2/10 |
| 2,623,236 | 2/1947 | Borchers et al. | 16/135 |
| 2,700,158 | 2/1950 | Larsen | 2/3 |
| 2,973,522 | 7/1957 | Edwards et al. | 2/8 |
| 3,021,527 | 6/1958 | Larsen | 2/8 |
| 3,383,706 | 5/1968 | Lobelle | 2/10 X |
| 3,553,734 | 1/1971 | Aileo | 2/10 |
| 3,582,991 | 12/1971 | Metz | 2/8 |
| 4,070,712 | 1/1978 | Marwitz | 2/10 |
| 4,124,296 | 11/1978 | Kishi et al. | 355/75 |
| 4,224,694 | 9/1980 | Palmaer | 2/422 |
| 4,539,713 | 9/1985 | Hodge | 2/8 |

FOREIGN PATENT DOCUMENTS

| | | | |
|---|---|---|---|
| 2084859 | 4/1982 | United Kingdom | 2/5 |

*Primary Examiner*—Peter Nerbun

*Attorney, Agent, or Firm*—Smith & Schnacke

[57] ABSTRACT

A fire fighter helmet of the type having a body which includes a peripheral brim, an arcuate face shield having an inwardly extending lip and a flexible gasket on the underside of the lip for forming a watertight seal with the brim when the shield is in a down position, and a pair of hinges attached to opposite sides of the helmet body and pivotably attached to the face shield. The hinges each include a hinge plate and a spring which is connected at one end to the shield and at an opposite to the hinge plate rearwardly and below the pivot connection between the hinge plate and face shield. The hinge plate also includes a stop defining an upper limit of travel for the face shield. The spring urges the shield to pivot either to an up position against the stop, or to a down position in which the gasket forms a watertight seal with the adjacent portion of the helmet body brim.

12 Claims, 3 Drawing Sheets

FIRE FIGHTER HELMET AND FACE SHIELD

BACKGROUND OF THE INVENTION

The present invention relates to firefighting helmets and, more particularly, to firefighting helmets fitted with protective face shields pivotable to an up or down position.

People whose employment subjects them to physical hazards often are required to wear protective headgear. For example, people employed as lumberjacks may be required to wear headgear such as that shown in Palmaer U.S. Pat. No. 4,224,694. That headgear includes a protective helmet having a brim projecting from a generally dome-shaped helmet body, a face shield in the form of an arcuate screen, and a pair of hinges that provide a pivot connection between the screen and the helmet body. While the screen conforms generally to the contour of the bill of the helmet, there is no physical connection between the screen and helmet body, except for the hinges.

The hinges each include pairs of link arms which are attached at one end to the screen and at an opposite end to a hinge plate that, in turn, is attached to the helmet. When the screen is pivoted upwardly, the arms bind against each other to define an upper limit of travel for the screen. Similarly, when the screen is pivoted downwardly, the link arms again bind against each other to define a lower limit of travel in which the screen substantially covers the face of a wearer of the helmet.

However effective such helmet designs are in the lumber and related industries, other professions, such as fire fighting, have hazards which are unique to that profession and for which such helmets as shown in the Palmaer patent may not provide adequate protection. In the fire fighting profession, a fire fighter may be required to enter a structure with which he is unfamiliar and which has been damaged substantially by fire. Consequently, there may be debris which project downwardly and sidewardly into the path taken by the fire fighter in the structure. If the firefighter is wearing a helmet in which the face shield projects above the top of the helmet when in an up or raised position, the shield may catch upon the projecting debris and cause the fire fighter's helmet and head to jerk backward. Debris projecting sidewardly into the path of the fire fighter may catch on the hinge mechanisms which, as in the Palmaer device, project well beyond the brim of the helmet. Furthermore, in the wet working environment of a fire fighter, the helmet is frequently doused with large quantities of water which run down the sides of the helmet and may seep through any gap between the brim and upper edge of the face shield. There, it may flow downwardly on the inside surface of the face shield and blur the fire fighter's vision through the shield.

Accordingly, there is a need for a fire fighter helmet which is specially designed to protect against hazards which are unique to the firefighting profession. In particular, such a helmet should minimize the likelihood of a raised face shield catching on an overhead projection, and minimize the likelihood of the face shield hinges catching on sidewardly projecting debris. Furthermore, there is a need for a fire fighter helmet which minimizes the likelihood of water flowing down the inside of the face shield to blur the vision of the wearer. There is also a need for a fire fighter helmet in which a hinge mechanism positively holds the face shield either in an up or down position, so that the likelihood of the face shield inadvertently pivoting from either of those positions is minimized.

SUMMARY OF THE INVENTION

The present invention is a fire fighter helmet having a face shield system specifically designed to protect the wearer from the hazards which are unique to the fire fighting profession. The fire fighter helmet includes a face shield having an inwardly extending lip along its upper periphery which carries a flexible gasket of resilient material shaped to overlie an adjacent portion of the helmet brim to form a watertight seal between the shield and brim when the shield is in the down position. The face shield is pivotably attached to the helmet body by spring-loaded hinges which hold the face shield firmly in either an up position or a down position. When the shield is in the down position, the spring-loaded hinges urge the lip of the shield downwardly against the helmet brim to provide a watertight fit for the gasket.

In the preferred embodiment, the hinges each include a hinge plate which extends upwardly from the helmet brim and is inclined inwardly to minimize the overhang of the hinge beyond the brim. The face shield includes a pair of upwardly projecting lobes which are attached to the hinge plates by pivot pins. An extension spring is attached at one end to the face shield and at its opposite end to the hinge plate at a point rearwardly of and below the pivot connection. The spring location provides an "overcenter" connection which causes the shield to pivot from an intermediate position to either an up or a down position, and holds the shield in that position. In addition, the shield can be easily pivoted to an up or down position with a gloved hand and the need for latching mechanisms is eliminated.

Also in the preferred embodiment, the hinge plate includes an outwardly extending lip which defines an upper limit of travel for the face shield, and is shaped such that the face shield in its up position does not extend above the top of the helmet body. Consequently, the shield is not prone to catch upon an overhead projection in the path of a wearer. Rather, an overhead projection would harmlessly contact the top of the helmet body.

Accordingly, it is an object of the present invention to provide a fire fighter helmet with a face shield system that includes a face shield fitted with a gasket that forms a seal with the helmet brim to prevent water from flowing between the face shield and brim; a face shield system in which the hinges are spring-loaded so that the face shield is positively held in either an up or a down position, and in which the spring tension holds the face shield downwardly against the helmet brim to ensure a watertight fit; a face shield system in which the hinges are shaped to minimize side overhang and are devoid of projecting members which may tend to catch upon debris; and a face shield system which is simple and rugged in construction, and is not prone to jamming in the field.

Other objects and advantages of the invention will be apparent from the following description, the accompanying drawings and the appended claims.

DETAILED DESCRIPTION OF THE PREFERRED EMBODIMENT

Figure 1:
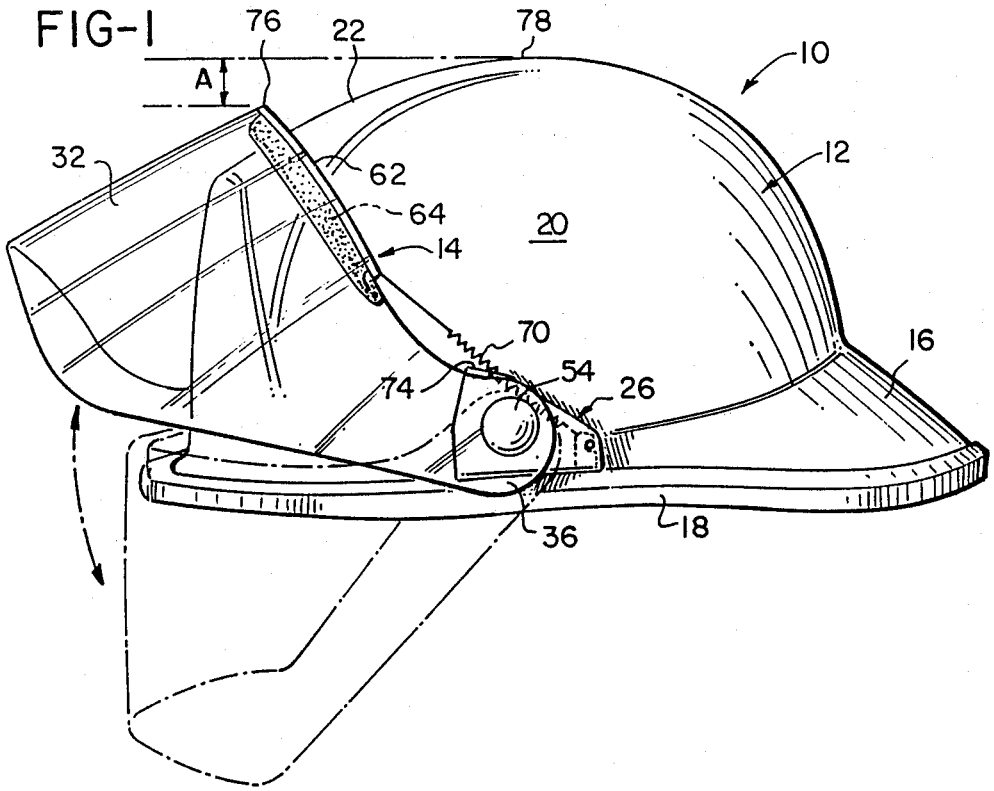
FIG. 1 is a side elevation of a preferred embodiment of the fire fighter helmet of the present invention, in which the face shield is pivoted to an up position and is shown in phantom in a down position.
Figure 2:
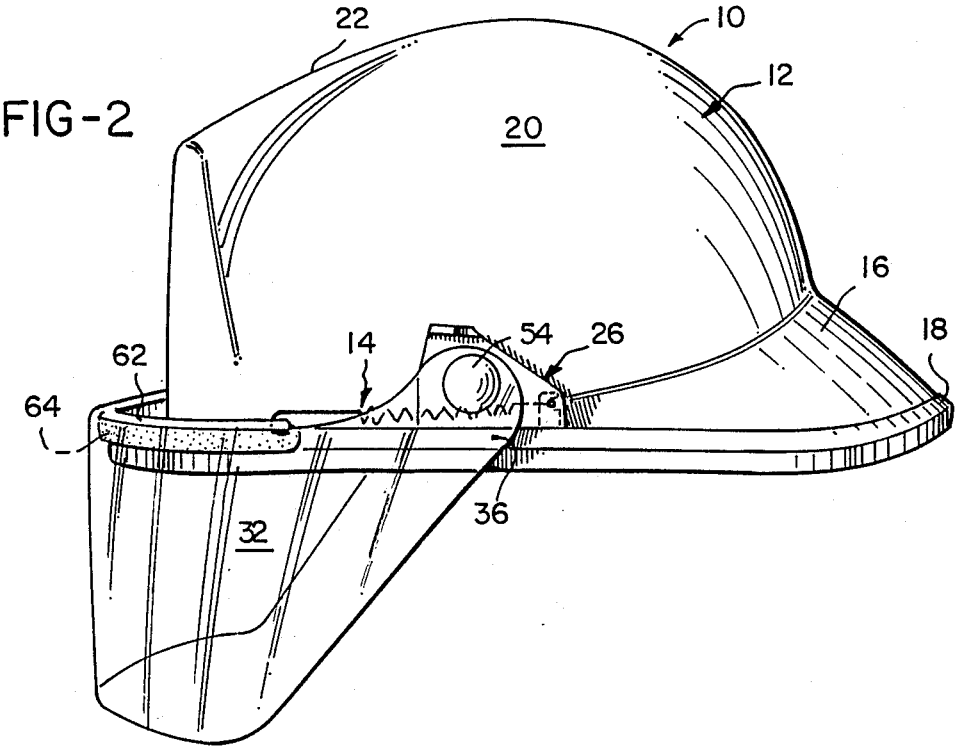
FIG. 2 is a side elevation of the fire fighting helmet of FIG. 1, in which the face shield is pivoted to the down position.

As shown in FIGS. 1 and 2, the fire fighter helmet of the present invention, generally designated 10, includes a helmet body 12 fitted with a shield system, generally designated 14. The helmet body 12 includes a peripheral brim 16 whose outer edge is covered with flexible, plastic molding 18. The brim 16 extends outwardly and downwardly from the dome 20 of the body 12, which includes a central ridge 22 (see also FIG. 6). Although not shown, the dome 20 of the helmet 10 includes interior webbing and a chin strap similar to other conventional fire helmets.

Figure 5:
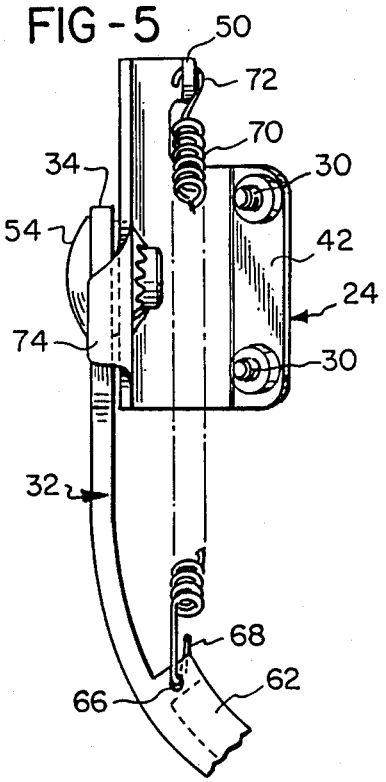
FIG. 5 is a top plan view of the hinge shown in FIG. 4.
Figure 6:
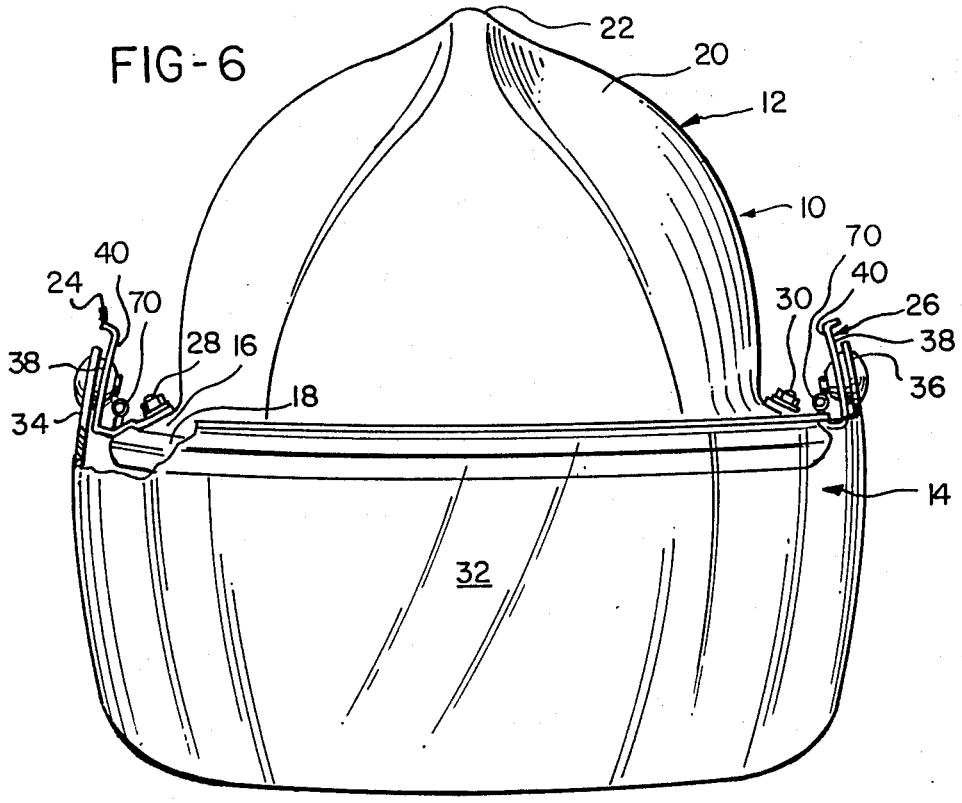
FIG. 6 is a front elevational view of the fire fighter helmet of FIG. 1, in which the face shield is in the down position and is partially broken away to reveal the right hinge.

As shown in FIGS. 1 and 6, the shield system 14 includes left and right hinges 24, 26 which are attached to the brim 16 by pairs of nut and bolt combinations 28, 30 (see also FIG. 5). A flexible plastic shield 32 is pivotably attached to the hinge members 24, 26 and is arcuately shaped to conform to the curve of the brim 16 at the front of the helmet 10. The shield 32 includes upwardly and rearwardly extending lobes 34, 36 which are shaped to be positioned in registry with the hinges 24, 26 and provide a bearing surface for the pivot connection.

Figure 3:
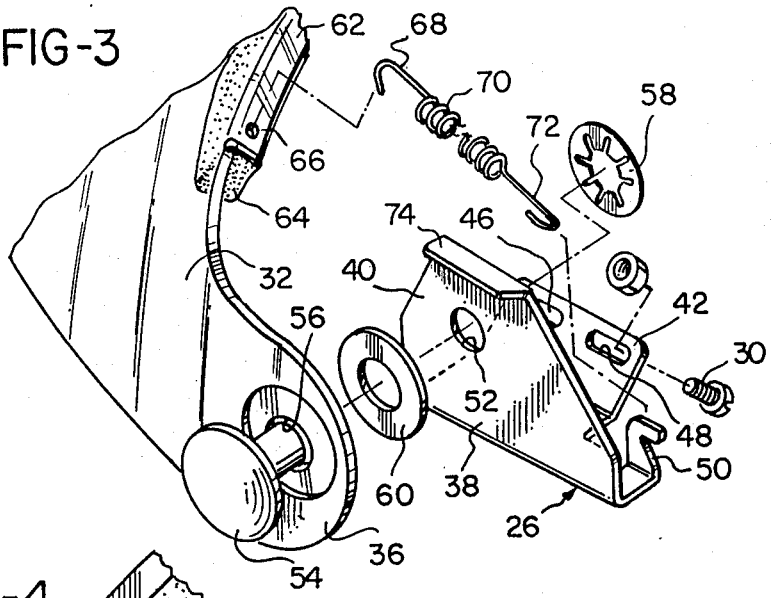
FIG. 3 is an exploded, perspective view of a hinge member of the fire fighter helmet of FIG. 1.
Figure 4:
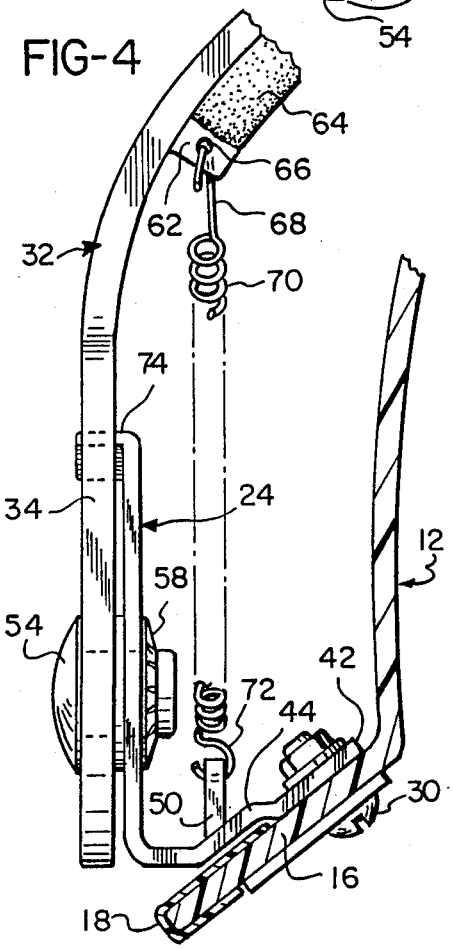
FIG. 4 is a front elevational detail of the helmet of FIG. 1, showing the right hinge and a portion of the helmet body in section.

Hinge 26 is shown in FIGS. 1–3 and 6 and hinge 24 is shown in FIGS. 5 and 6. The following description of the structure of hinges 24, 26 is provided with the understanding that the components of the hinges are identical in all respects, but that right hinge 24 is a mirror image of left hinge 26. As shown in FIGS. 3–5 hinges 24, 26 each include a hinge plate 38 having an upright portion 40 and an inwardly extending leg portion 42. Leg portion 42 includes an offset 44 which provides clearance for the molding 18 when the leg is attached to the brim 16, and is angled relative to the upright portion 40 so that the upright portion is inclined inwardly when the hinges are mounted on the brim 16 (see FIG. 6). The leg portion 42 also includes front and rear slots 46, 48 to receive the nut and bolt combinations 28, 30, and a hook 50 at a rearward end.

The upright portions 40 of hinges 24, 26 each include a central orifice 52 which receives a pivot pin 54. The pivot pins 54 extends through openings 56 in the lobes 36, 38 of the shield 32 and are retained within the holes 56 and bores 52 by snap retainers 58. Washers 60 are journaled onto the pivot pins 54 and are positioned between the lobe 36, 38 and upright portions 40.

As shown in FIG. 2, the shield 32 includes an inwardly extending lip 62 which extends along the upper periphery 64 of the shield and is positioned to overlap the brim 16 and molding 18 when the shield is in the down position. A gasket 64, made of a strip of flexible material such as foam, is adhesively attached to the underside of the lip 62, and is positioned to make a watertight seal between the lip and molding 18 when the shield 32 is in the down position.

As shown in FIGS. 3–5, holes 66 are formed in the ends of the lip 62 and receive the hooked ends 68 of extension springs 70. Extension springs 70 include opposite hooked ends 72 which are attached to the hooks 50 of the hinge plates 24, 26. The hooks 50 of the hinge plates 24, 26 are positioned rearwardly of and below the pivot axis of the shield 32, defined by pivot pins 54. Consequently, the spring 70 exerts a moment of force on the shield which, when in the down position, causes the shield to pivot downwardly and urges the lip 62 against the brim 16, so that the gasket 64 is pressed against the molding 18 to ensure a watertight fit.

The upright portions 40 of the hinge plates 38 each include an outwardly extending lip 74 which is positioned to contact an upper edge of the lobes 34, 36 when the shield 32 is raised, thereby acting as a stop which defines an upper limit of travel for the shield 32. As shown FIG. 1, these stops 74 position the shield 32 when in the up position so that the top most portion of the shield 76 is at a distance A below the top most portion 78 of the helmet body 12. Consequently, when in the up position, the shield 32 does not project above the helmet to catch on any low hanging debris that might be encountered by a wearer in field conditions.

Furthermore, the spring 70 exerts a moment on the shield 32, causing it to remain pivoted upwardly against the stops 74. In general, the offset arrangement of the spring from the pivot pin 54 reduces the likelihood that the shield will rests at a position intermediate the up and down positions shown in FIGS. 1 and 2, respectively. Accordingly, a slight upward or downward pull by the wearer is normally sufficient to change the position of the shield relative to the helmet body 12.

As shown in FIG. 6, the springs 70 are mounted on the hinges 24, 26 inboard of the upright portions 40 of the hinge plates 38. This further reduces the side overhang of the hinges 24, 26 beyond the brim 16 of the helmet 10 and reduces the likelihood that the springs become entangled in debris projecting into the wearer's path.

In the preferred embodiment, the hinge plates 38 are made of stainless steel, as are the nut and bolt combinations 30, the pivot pins 54 are made of aluminum, and the springs 70 are made of spring stainless steel which is copper plated.

While the form of apparatus herein discribed constitutes a preferred embodiment of the invention, it is to be understood that the invention is not limited to this precise form of apparatus, and that changes may be made therein without departing from the scope of the invention.

What is claimed is:

1. In a fire fighter helmet of the type having a body including a peripheral brim, an improved face shield system comprising:

an arcuate face sheild;

hinge means for connecting said shield to said helmet body to pivot between an up position, wherein said shield is substantially above a face of a user, and a down position, wherein said shield extends below said brim and is in front of a face of a user;

said hinge means including at least one hinge having a hinge plate attached to a side of said body, a pivot pin, defining a pivot axis of said shield, extending through said shield and journaled into said hinge plate, and resilient means attached to said hinge plate rearwardly of said pin and attached to said shield forwardly of said pin; and said hinge plate having an upright portion receiving said pivot pin and an inwardly extending leg portion attached to said helmet body and angled relative to said upright portion such that said upright portion is inclined inwardly toward said helmet, thereby minimizing side overhang of said hinge.

2. The shield system of claim 1 further comprising gasket means for forming a watertight seal between said brim and said shield when said shield is in said down position, whereby water running down said helmet body is prevented from dripping from said brim behind said shield.

3. The shield system of claim 2 wherein said gasket means includes said shield having an inwardly-extending lip at an upper edge thereof and positioned to overlie a segment of said brim above the face of a user.

4. The shield system of claim 3 wherein said gasket means includes a strip of resilient material attached to and extending along an underside of said lip and positioned to engage said brim when said shield is in said down position.

5. The shield system of claim 1 wherein said hinge plate includes stop means, unitary with said upright portion, defining an upper limit of pivotal movement of said shield.

6. The shield system of claim 5 wherein said stop means includes an outwardly-extending lip formed on said upright portion and positioned to engage an upper edge of said shield.

7. The shield system of claim 5 wherein said stop means is shaped to prevent said shield from pivoting above a topmost point of said helmet body.

8. In a fire fighter helmet of the type having a body including a peripheral brim, an improved face shield system comprising:

a face shield having a contour shaped to conform to a contour of a front portion of said brim and means for retaining a gasket thereon;

hinge means for pivotably attaching said shield to said helmet body such that said shield pivots to an up position, wherein said shield is above the face of a user, and to a down position, wherein said shield extends below said brim and covers a face of a user and said gasket retaining means is positioned adjacent to said brim;

means for biasing said face shield to said down position such that said gasket retaining means is biased against said brim; and gasket means, mounted on said retaining means, for forming a watertight seal between said shield and said front portion of said brim when said shield is in said down position, whereby said biasing means compresses said gasket means between said retaining means and said front portion to make a watertight seal therebetween.

9. The face shield system of claim 8, wherein said retaining means includes an inwardly-extending lip at an upper edge thereof shaped to overlie said front portion of said brim.

10. The face shield system of claim 9, wherein said gasket means includes a strip of resilient material attached to and extending along an underside of said lip and positioned to engage said brim when said shield is in said down position.

11. In a fire fighter helmet of the type having a body including a peripheral brim, and improved face shield system comprising;

a face shield shaped to conform to a curvature of a front portion of said brim and including an inwardly-extending lip and a pair of upwardly directed lobes at ends of said shield;

a pair of hinges mounted on opposite sides of said helmet body, each of said hinges including an upright portion inclined inwardly from said brim to minimize side overhang and having an outwardly-extending lip at an upper end thereof, a leg portion attached to said helmet body, a pivot pin extending through an adjacent one of said lobes and journaled into said upright portion, forming a pivot connection between said lobe and said upright portion, and a coil spring attached at one end thereof to said shield below said lobe and at an opposite end thereof to said upright portion rearwardly of and below said pivot connection, whereby said spring holds said shield in a up position against said outwardly extending lip and in a down position wherein said inwardly extending lip overlies said brim; and a strip of resilient material attached to an underside of said inwardly extending lip to form a substantially watertight seal with said front portion of said brim when said shield is in said down position to prevent water flowing down said helmet body from passing between said shield and said brim and then behind said shield.

12. The face shield system of claim 8 wherein said gasket means and said gasket retaining means are positioned to prevent further downward pivoting movement of said face shield beyond a predetermined position thereof relative to said helmet body, thereby acting as a lower stop for said face shield.

* * * * *